US009125263B2

(12) United States Patent
Tateishi et al.

(10) Patent No.: US 9,125,263 B2
(45) Date of Patent: Sep. 1, 2015

(54) LED LIGHTING DEVICE

(75) Inventors: Norikazu Tateishi, Tokyo (JP); Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 232 days.

(21) Appl. No.: 14/004,876

(22) PCT Filed: Aug. 5, 2011

(86) PCT No.: PCT/JP2011/004469

§ 371 (c)(1),
(2), (4) Date: Sep. 12, 2013

(87) PCT Pub. No.: WO2013/021412

PCT Pub. Date: Feb. 14, 2013

(65) Prior Publication Data

US 2014/0001969 A1 Jan. 2, 2014

(51) Int. Cl.
*H05B 41/00* (2006.01)
*H05B 33/08* (2006.01)

(52) U.S. Cl.
CPC ..... *H05B 33/0815* (2013.01); *H05B 33/083* (2013.01); *H05B 33/0809* (2013.01); *H05B 33/0821* (2013.01); *H05B 33/0827* (2013.01)

(58) Field of Classification Search
None
See application file for complete search history.

(56) References Cited

U.S. PATENT DOCUMENTS

| | | | | |
|---|---|---|---|---|
| 8,664,870 | B2 * | 3/2014 | Su et al. | 315/201 |
| 8,692,472 | B2 * | 4/2014 | Fujimoto | 315/186 |
| 2004/0251854 | A1 * | 12/2004 | Matsuda et al. | 315/291 |
| 2009/0167197 | A1 * | 7/2009 | Wang et al. | 315/185 R |
| 2010/0134041 | A1 | 6/2010 | Radermacher et al. | |
| 2011/0115770 | A1 * | 5/2011 | Seo et al. | 345/211 |
| 2012/0187864 | A1 * | 7/2012 | Iwai et al. | 315/291 |
| 2012/0299492 | A1 | 11/2012 | Egawa et al. | |
| 2012/0313541 | A1 | 12/2012 | Egawa et al. | |
| 2013/0257279 | A1 * | 10/2013 | Le | 315/113 |
| 2014/0361711 | A1 * | 12/2014 | Takahashi | 315/294 |

FOREIGN PATENT DOCUMENTS

| | | | |
|---|---|---|---|
| CN | 1575080 | A | 2/2005 |
| JP | 2006-4839 | A | 1/2006 |
| JP | 2009-289940 | A | 12/2009 |
| JP | 2009-302296 | A | 12/2009 |
| JP | 2010-527459 | A | 8/2010 |
| WO | WO 2011/096585 | A1 | 8/2011 |
| WO | WO 2011/105630 | A1 | 9/2011 |

* cited by examiner

*Primary Examiner* — Tuan T Lam
(74) *Attorney, Agent, or Firm* — Birch, Stewart, Kolasch & Birch, LLP

(57) ABSTRACT

An LED lighting device 1 lights LED blocks 4*a* and 4*b* which correspond to a plurality of functions of an illuminator such as headlights and are connected in series. The LED blocks 4*a* and 4*b* are connected in series with a current converting unit 5. While the LED blocks 4*a* and 4*b* are supplied with a current Ia from a single DC/DC converter unit 3, the LED block 4*b* is supplied with a current Ib that passes through conversion by the current converting unit 5 and that differs from the current Ia the DC/DC converter unit 3 outputs. Thus, the LED blocks 4*a* and 4*b* are each lit with appropriate brightness.

10 Claims, 7 Drawing Sheets

LED LIGHTING DEVICE

TECHNICAL FIELD

The present invention relates to an LED lighting device that lights a plurality of LEDs (Light Emitting Diodes) connected in series by causing a first current to flow through a part of the LEDs and a second current different from the first current to flow through the other LEDs.

BACKGROUND ART

As an onboard light source, longer-life, maintenance-free LEDs have been spread as a substitute for conventional tungsten lamps. Since the LEDs have longer life and are able to maintain required brightness with smaller power and stable brightness with simple control that supplies a constant current, they are appropriate to an onboard light source. For the same reason, LEDs are rightly used as a light source other than the onboard light source.

Incidentally, the brightness of the light an LED emits is mainly determined by the current flowing through it. In addition, as for LEDs corresponding to lighting functions such as those of the antidazzle lights and running lights of headlights and those of the taillights and sidelights of a rear combination lamp, LEDs suitable for these functions are selected. Accordingly, although the current flowing through LEDs of a single illuminator varies depending on the individual functions, it is preferable for a lighting device to collectively supply the currents to the LEDs with the individual functions. As configurations of a lighting device that turns on a plurality of LEDs with different currents at the same time, Patent Documents 1-3 are proposed, for example.

An LED lighting unit of the Patent Document 1, which emits white light by turning on red, blue and green LEDs, has the red, blue and green LEDs that have different applied currents and are arranged in parallel with respect to a power supply, and has current adjusting circuits (current limiting resistors) for them, respectively.

A lighting unit of the Patent Document 2 has two types of LEDs that have different applied currents and are connected in series, and uses a transformer having the principal secondary winding and subordinate secondary winding. The transformer supplies the LEDs connected in series with the current output from its principal secondary winding (principal current) and supplies a part of the LEDs connected in series with the total current of the principal current and the current from the subordinate secondary winding (subordinate current), thereby increasing the brightness.

A lighting unit relating to the Patent Document 3, which simultaneously turns on two types of LEDs that have different forward voltages and are connected in series, comprises a current control unit connected in parallel with the LEDs with higher forward voltage. The current control unit adjusts the forward current flowing through the LEDs with the higher forward voltage, thereby keeping the balance between the power supplied to the LEDs with the higher forward voltage and the power supplied to the LEDs with lower forward voltage.

PRIOR ART DOCUMENT

Patent Document

Patent Document 1: Japanese Patent Laid-Open No. 2006-4839.

Patent Document 2: Japanese Patent Laid-Open No. 2009-289940.

Patent Document 3: Japanese Patent Laid-Open No. 2009-302296.

DISCLOSURE OF THE INVENTION

Problems to be Solved by the Invention

The technique disclosed in the Patent Document 1, which controls the currents to be supplied to the LEDs separately, is not suitable for a power-saving device because of a loss due to the current limiting resistors connected in series with the LEDs.

In addition, the technique disclosed in the Patent Document 2, which uses the transformer with the plurality of secondary windings, is not suitable for a power-saving device because of the complicated configuration that necessitates the separate power supplies and because of the resistor used for controlling the subordinate current.

Furthermore, the technique disclosed in the Patent Document 3, which bypasses the current for lighting by connecting the resistor in parallel with the LEDs with the higher forward voltage, is not suitable for a power-saving device because of a power loss due to the resistor.

Thus, the techniques in accordance with the Patent Documents 1-3 have a problem in that although they can light the plurality of LEDs by supplying the plurality of currents, they have a complicated configuration or bring about a power loss.

The present invention is implemented to solve the foregoing problems. Therefore it is an object of the present invention to provide an LED lighting device capable of supplying different currents with a simple configuration.

Means for Solving the Problems

An LED lighting device in accordance with the present invention comprises a DC/DC converter unit that generates a first current for lighting at least a first LED from a power supply; a current converting unit that converts the first current to a second current for lighting a second LED; and a control unit that controls the DC/DC converter unit and the current converting unit, wherein the current converting unit is connected in series between the first LED and the second LED.

Advantages of the Invention

According to the present invention, it is configured in such a manner as to supply the first current to the first LED and to the second LED connected in series by using a single DC/DC converter unit, and to supply the second current different from the first current to the second LED by the current converting unit provided between the first LED and the second LED. Accordingly, it can offer an LED lighting device capable of supplying the different currents simultaneously with a simple configuration comprising the DC/DC converter unit and the current converting unit.

BEST MODE FOR CARRYING OUT THE INVENTION

The best mode for carrying out the invention will now be described with reference to the accompanying drawings to explain the present invention in more detail.

Embodiment 1

Figure 1:
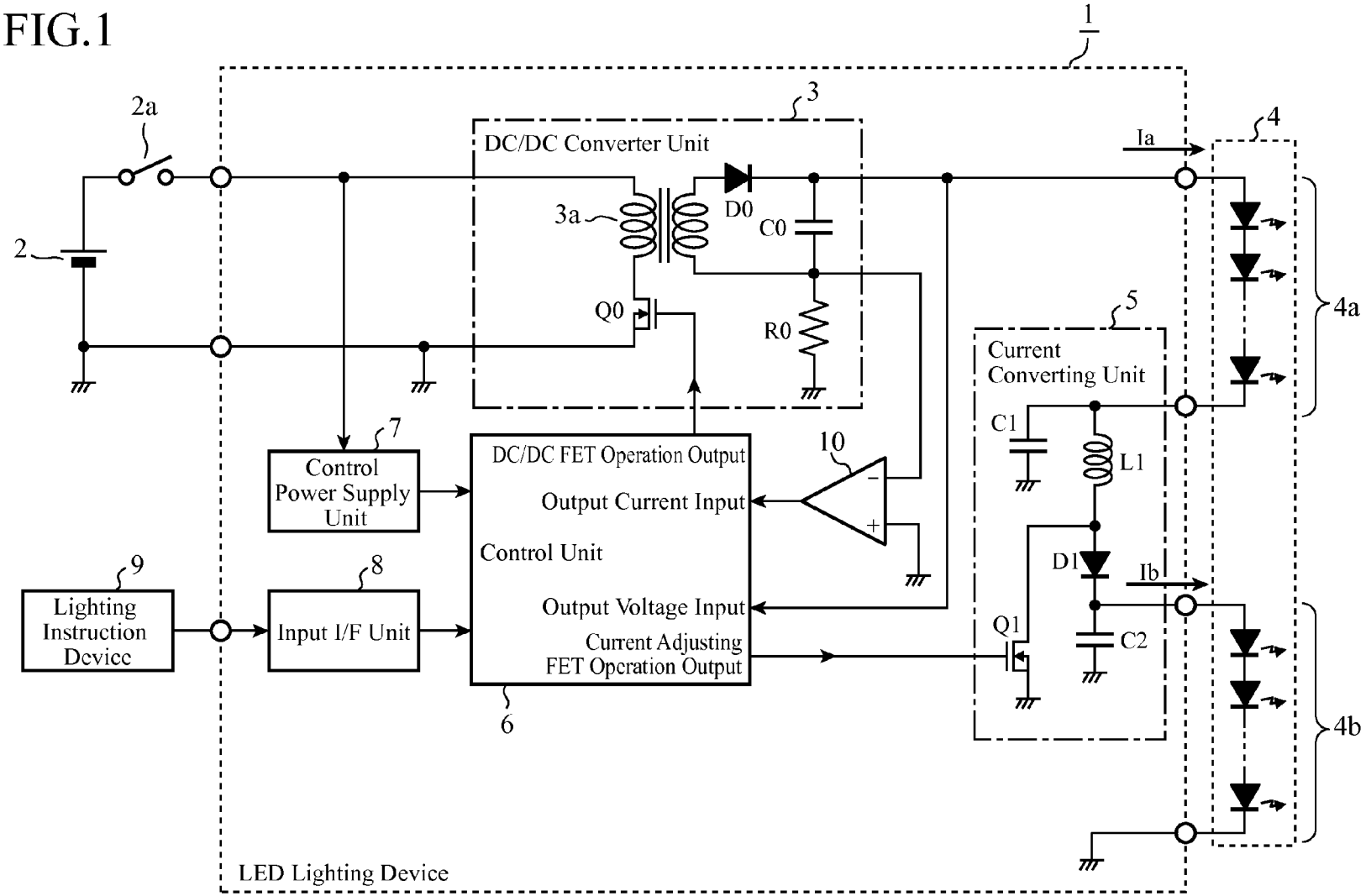
FIG. 1 is a circuit diagram showing a configuration of an LED lighting device of an embodiment 1 in accordance with the present invention.

The LED lighting device 1 shown in FIG. 1 is a device that lights an LED light source 4 using the DC voltage of a DC power supply 2, and basically comprises a DC/DC converter unit 3, a current converting unit 5, a control unit 6, a control power supply unit 7, and an input interface (referred to I/F from now on) unit 8. The DC power supply 2, which is a power source that feeds the DC voltage to the LED lighting device 1, makes or breaks the DC voltage supply to the LED lighting device 1 through the power switch 2*a*. In addition, a lighting instruction device 9, an external device, is connected to the LED lighting device 1.

The LED light source 4 comprises a series connection of an LED block 4*a* (first LED) having one or more LEDs connected in series and an LED block 4*b* (second LED) having one or more LEDs connected in series. Incidentally, the LED block 4*a* and the LED block 4*b* are light sources that achieve different functions and have different applied currents. In the present embodiment 1, the current Ia (first current) required for lighting the LED block 4*a* is greater than the current Ib (second current) required for lighting the LED block 4*b*.

For example, to apply the LED light source 4 to an onboard rear combination lamp, the LED block 4*a* is used as a taillight and the LED block 4*b* is used as the sidelights, in which case the LED block 4*b* for the sidelights is lit darker with a current less than that of the LED block 4*a* for the taillight.

The DC/DC converter unit 3 comprises a transformer 3*a* (or coil), a switching element Q0 consisting of a MOS field-effect transistor (FET), a rectifier diode D0 and a smoothing capacitor C0, and generates a current Ia for lighting the LED light source 4 from the DC power of the DC power supply 2. The DC/DC converter unit 3 carries out PWM (Pulse Width Modulation) control of the switching element Q0 by the DC/DC FET operation output signal from the control unit 6, stores magnetic energy into the transformer 3*a*, generates voltage in the transformer 3*a* by discharging it, rectifies the voltage through the rectifier diode D0, and smoothes it using the smoothing capacitor C0, thereby generating the DC voltage. The smoothing capacitor C0 has its first terminal connected to the anode terminal of the LED light source 4 to supply the LED light source 4 with the current Ia the DC/DC converter unit 3 generates. In addition, the smoothing capacitor C0 has its first terminal connected to the output voltage input terminal of the control unit 6 to feed back the output voltage of the DC/DC converter unit 3. The smoothing capacitor C0 has its second terminal connected to a current detecting resistor R0 and to the inverting input of an inverting amplifier 10. The noninverting input of the inverting amplifier 10 is grounded and the output current of the DC/DC converter unit 3 is fed back via the inverting amplifier 10.

Incidentally, as the switching element Q0 (and as switching elements Q1-Q4 that will be described later), various types of transistors such as an IGBT (Insulated Gate Bipolar Transistor) can be used besides the FET as shown in FIG. 1.

The current converting unit 5 is connected in series between the LED block 4*a* and LED block 4*b*, and converts the current Ia the DC/DC converter unit 3 generates to the current Ib for lighting the LED block 4*b*. The current converting unit 5 comprises a coil L1, a switching element Q1 (first switching element), a diode D1 and capacitors C1 and C2, and the LED block 4*a* has its cathode terminal connected to the drain terminal of the switching element Q1 via the coil L1. In addition, the switching element Q1 has its drain terminal connected to the anode terminal of the LED block 4*b* via the diode D1, and has its source terminal grounded. Furthermore, the gate terminal of the switching element Q1 is connected to the current adjusting FET operation output terminal of the control unit 6, and is driven by the current adjusting FET operation output signal. In addition, the connection point of the LED block 4*a* to the coil L1 is grounded through the capacitor C1, and the connection point of the diode D1 to the LED block 4*b* is grounded through the capacitor C2.

The control unit 6 comprises a control IC for the DC/DC converter, which is not shown, and a CPU and an A/D converter which will be described later, generates a DC/DC FET operation output signal (PWM signal) whose duty cycle is altered in such a manner that the output current to be supplied to the output current input terminal has an asymptote to the target value (current Ia), and supplies it to the gate terminal of the switching element Q0. Incidentally, as for the constant-current control of the DC/DC converter unit 3 by the control unit 6, since it can be carried out using a publicly known method, the detailed description thereof will be omitted.

In addition, the control unit 6 generates a rectangular wave with a given period and duty cycle, and supplies it to the gate terminal of the switching element Q1 as the current adjusting FET operation output signal.

Furthermore, the control unit 6 can be connected to the external lighting instruction device 9 via the input I/F unit 8, and can be configured in such a manner as to enable or disable the current converting unit 5 in response to the control signal from the lighting instruction device 9.

The control power supply unit 7 supplies the control unit 6 with the control power.

Figure 2:
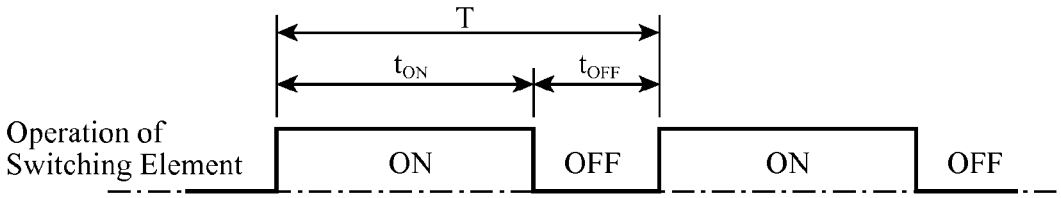
FIG. 2 is a graph schematically showing the operation of a switching element.
Figure 3:
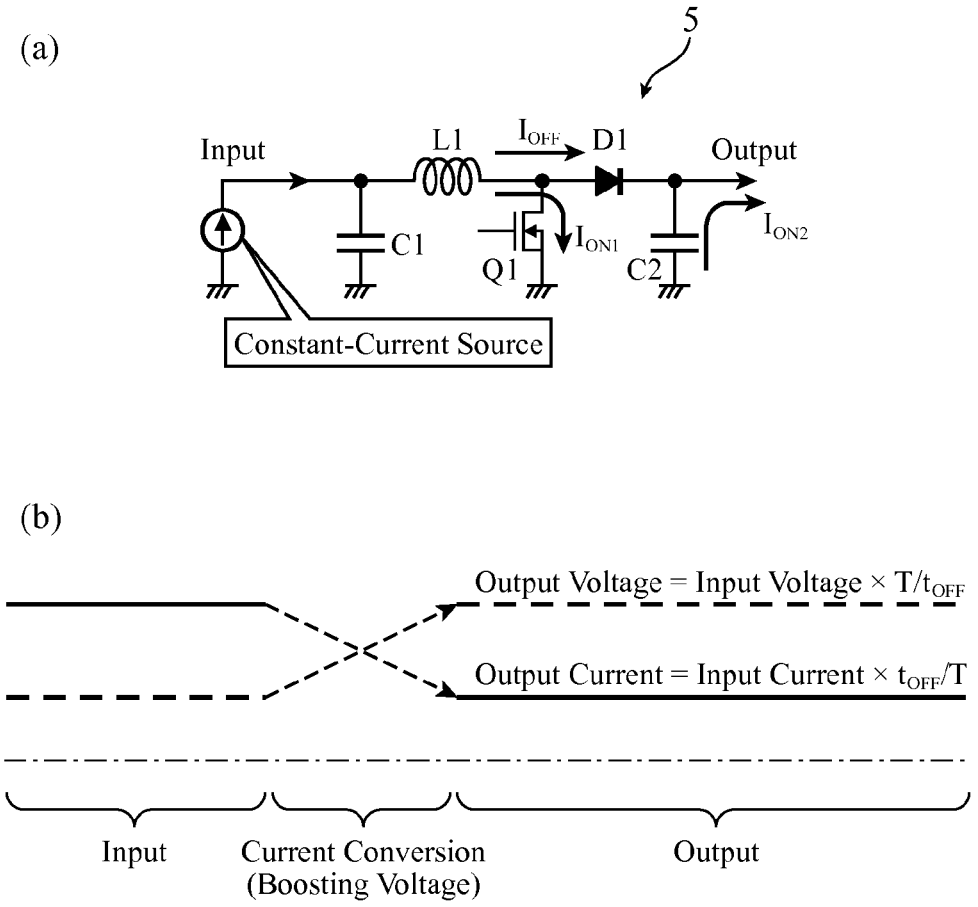
FIG. 3 is a diagram showing the operation of the current converting unit of the embodiment 1.

FIG. 2 is a graph schematically showing the switching operation of the switching element Q1, where T is the period of driving, $t_{ON}$ is the duration of switch on, and $t_{OFF}$ is the duration of switch off. FIG. 3(*a*) is a diagram showing the operation of the current converting unit 5, and FIG. 3(*b*) is a graph schematically showing the input/output current and voltage. The current converting unit 5 has its input connected to the constant-current source, that is, the LED block 4*a* lit by the constant-current Ia controlled by the control unit 6, and has its output connected to the LED block 4*b*.

When the switching element Q1 is turned off in response to the current adjusting FET operation output signal from the control unit 6, the current $I_{OFF}$ flows from the coil L1 to the capacitor C2 and the output side via the diode D1, thereby charging the capacitor C2. When the switching element Q1 is turned on, the current $I_{ON1}$ flows through the coil L1 to store the magnetic energy, and the current $I_{ON2}$ flows from the capacitor C2, which has already stored the charge, to the output side at the same time.

Connecting the LED block 4*b* with the constant-voltage characteristic to the output side brings about the following relationships: input voltage=output voltage×($t_{OFF}$/T); and output voltage=input voltage×(T/$t_{OFF}$). In this case, the output voltage equals the forward voltage drop of the LED block 4*b*. Accordingly, the input voltage to the current converting unit 5 is lower than the forward voltage drop of the LED block 4*b*. Thus, the current converting unit 5 and the LED block 4*b*, which operate as the load of the DC/DC converter unit 3, correspond to an LED block with the forward voltage drop lower than that of the LED block 4*b* that passes the current Ia. Incidentally, the output current Ib=input current Ia×($t_{OFF}$/T), and hence the current Ib lower than the current Ia flowing through the LED block 4*a* flows through the LED block 4*b*.

The term ($t_{OFF}$/T) indicates the duty cycle of the switching element Q1. Accordingly, driving the switching element Q1 at any given fixed duty cycle by the control unit 6 enables converting the current Ia for lighting the LED block 4*a* to the smaller current Ib for lighting the LED block 4*b*. This enables the single DC/DC converter unit 3 to output the two different currents Ia and Ib simultaneously.

Incidentally, although the current Ib is basically determined by the duty cycle of the switching element Q1, the relationships between the duty cycle and the output voltage and output current described above are achieved in an ideal condition. Realistically, however, it is preferable to set the frequency (period T) of the rectangular wave of the current adjusting FET operation output signal to the frequency matching the characteristics of the coil L1, switching element Q1 and diode D1 used, thereby setting to the duty cycle that is corrected considering the effect of the efficiency.

Although the current converting unit 5 comprises the coil, switching element and diode as the DC/DC converter unit 3, it does not comprise a feedback circuit necessary for the DC/DC converter unit 3. In other words, the current converting unit 5 does not require feedback, and has a configuration of converting to any desired current in response to the current adjusting FET operation output signal with a constant rectangular wave. Accordingly, as for the control of the current converting unit 5, it is not necessary for the control unit 6 to carry out complicated feedback processing of the output current, and only simple open loop control is required.

In addition, the LED lighting device 1 can have a configuration that comprises the input I/F unit 8 which connects the lighting instruction device 9 to the control unit 6 and supplies the control signal from the external lighting instruction device 9 to the control unit 6.

Receiving the control signal instructing to enable the current converting unit 5 from the lighting instruction device 9, the control unit 6 outputs the current adjusting FET operation output signal with the given period T and the duty cycle (=$t_{OFF}$/T) as described above, and drives the switching element Q1. This enables lighting the LED block 4*a* and LED block 4*b* simultaneously using the different currents Ia and Ib.

On the other hand, receiving the control signal instructing to disable the current converting unit 5 (fixing the switching element Q1 in the off state), the control unit 6 outputs the current adjusting FET operation output signal for stopping the switching element Q1 in the off state (fixed duty cycle=1). This enables the same current Ia to flow through the LED block 4*a* and LED block 4*b*.

In contrast, receiving the control signal instructing to disable the current converting unit 5 (fixing the switching element Q1 in the on state), the control unit 6 outputs the current adjusting FET operation output signal for stopping the switching element Q1 in the on state (fixed duty cycle=0). This enables breaking the current to the LED block 4*b*, thereby being able to extinguish the LED block 4*b*.

For example, applying the LED light source 4 to the onboard rear combination lamp as mentioned above enables lighting the sidelight LED block 4*b* at the same brightness as the LED block 4*a* or extinguishing them. Accordingly, it can be used as a directional indicator. In this case, the lighting instruction device 9 corresponds to a control device that processes the signal of the direction indicator switch or the like provided near the wheel of a vehicle.

As described above, according to the embodiment 1, the LED lighting device 1, which supplies the prescribed current generated from the DC power supply 2 to the LED light source 4 consisting of the LED block 4*a* and LED block 4*b* connected in series, comprises the DC/DC converter unit 3 that generates from the DC power supply 2 the current Ia for lighting at least the LED block 4*a*; the current converting unit 5 that is connected in series between the LED block 4*a* and the LED block 4*b* and converts the current Ia to the current Ib for lighting the LED block 4*b*; and the control unit 6 that carries out the feedback control of the DC/DC converter unit 3 and the open loop control of the current converting unit 5. Accordingly, it can provide the LED lighting device 1 capable of outputting the different currents Ia and Ib simultaneously with a simple configuration comprising the DC/DC converter unit 3 and the current converting unit 5.

In addition, according to the embodiment 1, the current converting unit 5 is configured in such a manner that it comprises the coil L1, switching element Q1 and diode D1, and that the switching element Q1 causes an intermittent current to flow from the coil L1 to the switching element Q1 by the on/off operation at the prescribed duty cycle instructed by the control unit 6. Accordingly, since it employs the coil L1 that stores the power in the form of the magnetic energy without using the resistor as the Patent Documents 1-3 described before, it can prevent the power loss, thereby being able to offer the LED lighting device 1 with higher efficiency.

In addition, according to the embodiment 1, the current converting unit 5 turns the current flowing from the coil L1 to the switching element Q1 on and off using the switching element Q1, thereby converting the current Ia the DC/DC converter unit 3 generates to the smaller current Ib. Accordingly, it can realize the LED lighting device 1 capable of outputting the current Ia and the current Ib smaller than the current Ia simultaneously by a simple configuration.

In addition, according to the embodiment 1, the LED lighting device 1 is configured in such a manner that it comprises the input I/F unit 8 that supplies the signal from the external lighting instruction device 9 to the control unit 6, and that the control unit 6 enables or disables the current converting unit 5 in response to the signal from the lighting instruction device 9. This enables a plurality of lighting operations of the LED light source 4 by an external operation such as using the sidelights of the rear combination lamps as a directional indicator.

Embodiment 2

Figure 4:
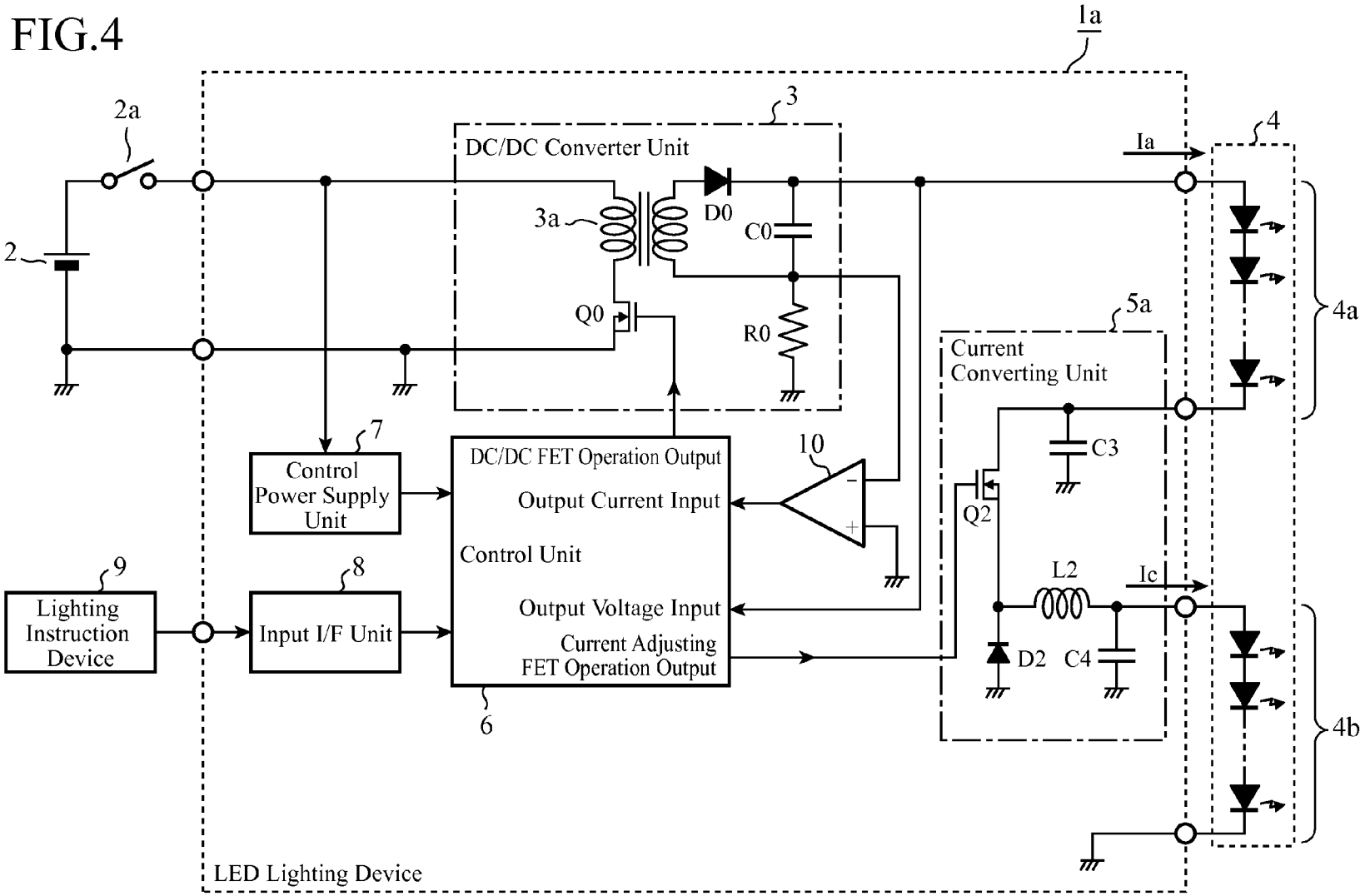
FIG. 4 is a circuit diagram showing a configuration of an LED lighting device of an embodiment 2 in accordance with the present invention.

FIG. 4 is a circuit diagram showing a configuration of an LED lighting device 1*a* of an embodiment 2 in accordance with the present invention. Incidentally, in FIG. 4, the same or like components to those of FIG. 1 are designated by the same reference numerals and their description will be omitted. Although the foregoing embodiment 1 was described using an example in which the current Ib for lighting the LED block 4*b* is smaller than the current Ia for lighting the LED block 4*a*, the present embodiment 2 will handle a case where a current Ic (second current) for lighting the LED block 4*b* is greater than the current Ia for lighting the LED block 4*a*.

For example, when applying the LED light source 4 to onboard headlights, using the LED block 4*a* as antidazzle lights (the low beam) and the LED block 4*b* as running lights (the high beam) will enable a greater current to flow through the LED block 4*b* used as the running lights than through the LED block 4*a* used as the antidazzle lights, thereby lighting the former brighter.

The current converting unit 5*a* is connected in series between the LED block 4*a* and LED block 4*b* to convert the current Ia to a greater current Ic. The current converting unit 5*a* comprises a coil L2, a switching element Q2 (second switching element), a diode D2 and capacitors C3 and C4, and the switching element Q2 has its drain terminal connected to the cathode terminal of the LED block 4*a*. The switching element Q2 has its source terminal connected to the anode terminal of the LED block 4*b* via the coil L2 and to the cathode terminal of the diode D2. Furthermore, the switching element Q2 has its gate terminal connected to the current adjusting FET operation output terminal of the control unit 6 to be driven by the current adjusting FET operation output signal. In addition, the connection point of the LED block 4*a* to the switching element Q2 is grounded via the capacitor C3, and the connection point of the coil L2 to the LED block 4*b* is grounded via the capacitor C4.

Figure 5:
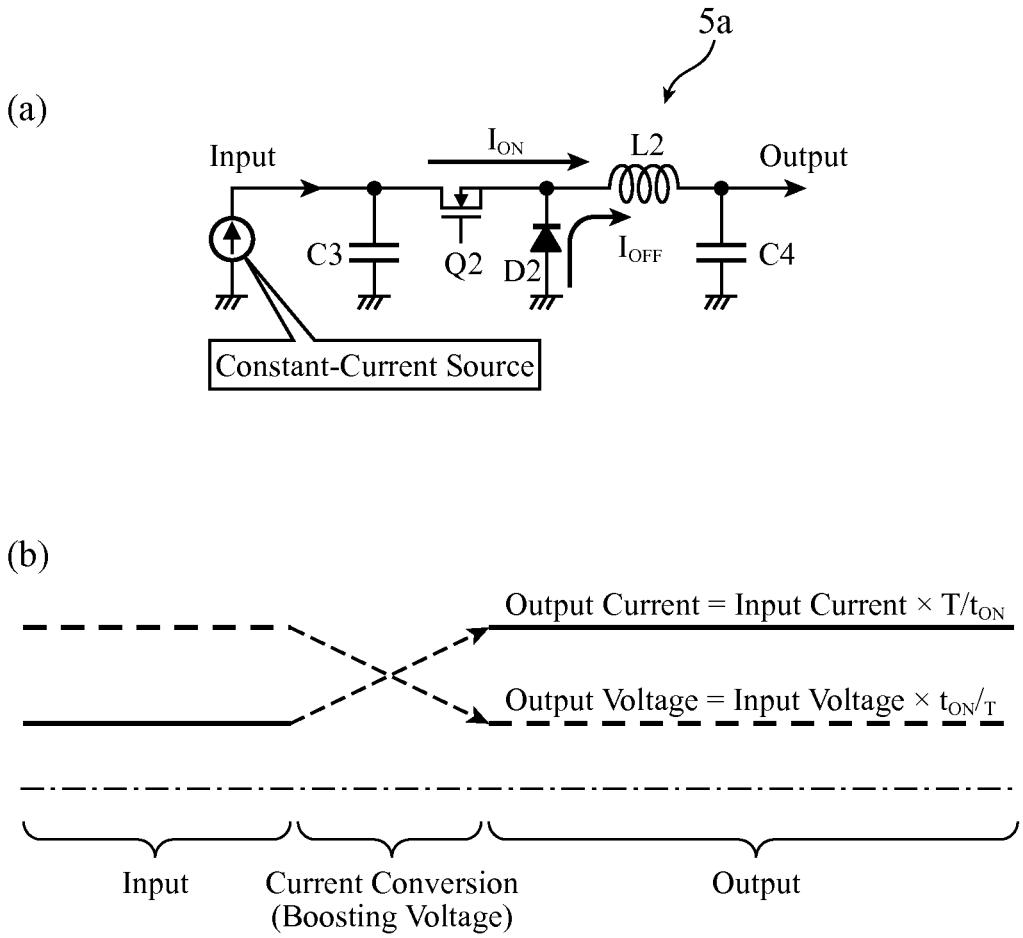
FIG. 5 is a diagram showing the operation of the current converting unit of the embodiment 2.

FIG. 5(*a*) is a diagram showing the operation of the current converting unit 5*a* and FIG. 5(*b*) is a graph schematically showing the input/output current and voltage. The current converting unit 5*a* has its input side connected to the LED block 4*a* and its output side connected to the LED block 4*b*.

When the switching element Q2 is turned on in response to the current adjusting FET operation output signal from the control unit 6, the current $I_{ON}$ corresponding to the output side load flows through the coil L2. When the switching element Q2 is turned off, the magnetic energy stored in the coil L2 causes the current $I_{OFF}$ to flow through the diode D2. The currents $I_{ON}$ and $I_{OFF}$ are smoothed with the coil L2 and capacitor C4 and flow to the output side.

Connecting the LED block 4*b* with the constant-voltage characteristic to the output side brings about relationships: input voltage=output voltage×($T/t_{ON}$); and output voltage=input voltage×($t_{ON}/T$). In this case, the output voltage equals the forward voltage drop of the LED block 4*b*. Accordingly, the input voltage to the current converting unit 5*a* is higher than the forward voltage drop of the LED block 4*b*. Thus, the current converting unit 5*a* and the LED block 4*b* operating as the load of the DC/DC converter unit 3 correspond to an LED block with the forward voltage drop higher than that of the LED block 4*b* that passes the current Ia. Incidentally, the output current Ic=input current Ia×($T/t_{ON}$) =input current Ib×($t_{ON}/T$), and hence the current Ic greater than the current Ia flowing through the LED block 4*a* flows through the LED block 4*b*.

The terra ($t_{ON}/T$) is the duty cycle of the switching element Q2. Accordingly, driving the switching element Q2 at any given fixed duty cycle by the control unit 6 enables the current Ia for lighting the LED block 4*a* to be converted to the greater current Ic for lighting the LED block 4*b*. This enables the single DC/DC converter unit 3 to output the two different currents Ia and Ic simultaneously.

Incidentally, although the current Ic is basically determined by the duty cycle of the switching element Q2 as in the foregoing embodiment 1, the relationships between the duty cycle and the output voltage and output current described above are achieved in an ideal condition. Realistically, however, it is preferable to set the frequency (period T) of the rectangular wave of the current adjusting FET operation output signal to the frequency matching the characteristics of the coil L2, switching element Q2 and diode D2 used, thereby setting the duty cycle to that that is corrected considering the effect of the efficiency.

In addition, in the LED lighting device 1*a*, the control unit 6 can accept the control signal from the lighting instruction device 9 via the input I/F unit 8. Receiving the control signal instructing to enable the current converting unit 5*a* from the lighting instruction device 9, the control unit 6 outputs the current adjusting FET operation output signal with the given period T and duty cycle (=$t_{ON}/T$) as described above, and drives the switching element Q2. This enables lighting the LED block 4*a* and LED block 4*b* simultaneously using the different currents Ia and Ic.

On the other hand, receiving the control signal instructing to disable the current converting unit 5*a* (to fix the switching element Q2 in the on state), the control unit 6 outputs the current adjusting FET operation output signal for stopping the switching element Q2 in the on state (fixed duty cycle=1). This enables the same current Ia to flow through the LED block 4*a* and LED block 4*b*.

For example, when applying the LED light source 4 to the onboard headlights as described above, it is possible to make the LED block 4*b* used as the running lights brighter by the current Ic or to reduce the brightness to the same level as the other LED block 4*a* by using the current Ia. Accordingly, it can be used not only as the running lights and antidazzle lights, but also as headlights for an expressway, which dim out the LED block 4*b* used for the running lights. In this case, the lighting instruction device 9 corresponds to a control device that processes a signal of a headlight switch or the like provided near the wheel of a vehicle.

Incidentally, in the LED lighting device 1*a* of FIG. 4, since the current applied to the LED light source 4 is ceased, the switching element Q2 is not fixed in the off state.

As described above, according to the embodiment 2, the current converting unit 5*a* of the LED lighting device 1*a* turns the input current on and off using the switching element Q2, thereby converting the current Ia the DC/DC converter unit 3 generates to the greater current Ic. Accordingly, it can realize the LED lighting device 1*a* capable of outputting the current Ia and the current Ic greater than the current Ia simultaneously with a simple configuration.

In addition, according to the embodiment 2, the current converting unit 5*a* is configured in such a manner that it comprises the coil L2, switching element Q2 and diode D2, and that the switching element Q2 causes an intermittent current to flow from the switching element Q2 to the coil L2 by the on/off operation at the prescribed duty cycle instructed by the control unit 6. Accordingly, it can prevent the power loss by employing the coil L2 that stores the power in the form of the magnetic energy as in the foregoing embodiment 1, thereby being able to offer the LED lighting device 1*a* with higher efficiency.

In addition, according to the embodiment 2, the LED lighting device 1*a* is configured in such a manner that it comprises the input I/F unit 8 that supplies the signal from the external lighting instruction device 9 to the control unit 6, and that the control unit 6 enables or disables the current converting unit 5*a* in response to the signal from the lighting instruction device 9. This enables the LED light source 4 to achieve a plurality of lighting operations in response to the external control such as using the running lights of the headlights as the headlights for an expressway by dimming them.

Embodiment 3

Figure 6:
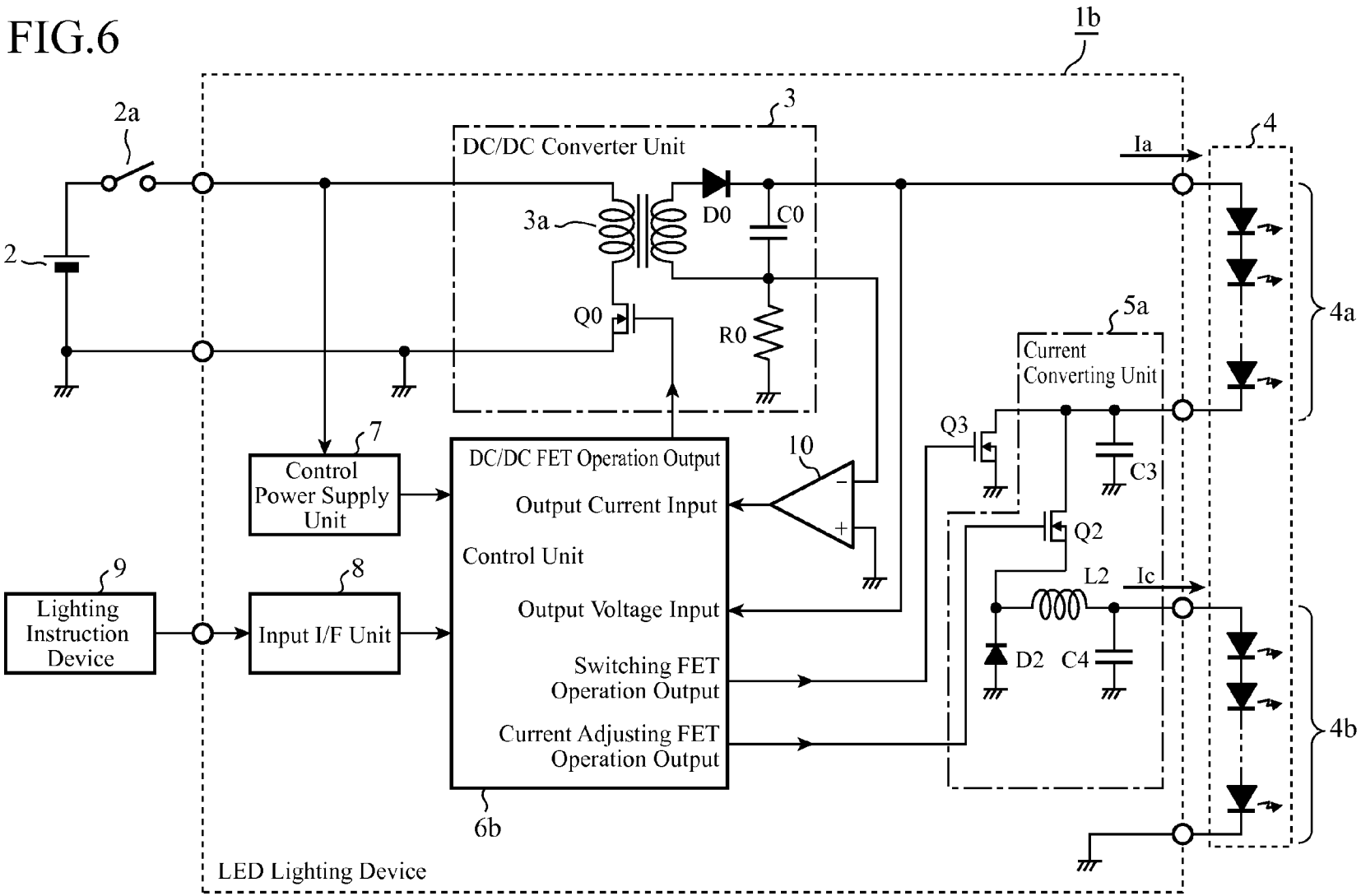
FIG. 6 is a circuit diagram showing a configuration of an LED lighting device of an embodiment 3 in accordance with the present invention.

FIG. 6 is a circuit diagram showing a configuration of an LED lighting device 1*b* of an embodiment 3 in accordance with the present invention. Incidentally, in FIG. 6, the same or like components to those of FIG. 4 are designated by the same reference numerals and their description will be omitted. In the present embodiment 3, a switching element Q3 (second switching element) that short-circuits or opens the current converting unit 5*a* is added to the LED lighting device 1*a* of the embodiment 2 shown in FIG. 4.

The switching element Q3 has its drain terminal connected to the connection point of the LED block 4*a* with the switching element Q2, and has its source terminal grounded. In addition, the switching element Q3 has its gate terminal connected to the switching FET operation output terminal of the control unit 6*b* to be switched on and off in response to the switching FET operation output signal.

The control unit 6*b* receives the control signal instructing the on/off operation of the switching element Q3 from the external lighting instruction device 9 via the input I/F unit 8, and turns the switching element Q3 on and off by outputting the switching FET operation output signal. When the switching element Q3 is off, the same lighting operation as that of the foregoing embodiment 2 is carried out. On the other hand, when the switching element Q3 is on, the current to the current converting unit 5*a* is broken, which can extinguish the LED block 4*b*.

For example, when applying the LED light source 4 to onboard headlights and lighting the LED block 4*a* used for the antidazzle light, the LED block 4*b* used for the running light can be extinguished.

As described above, according to the embodiment 3, the LED lighting device 1*b* is configured in such a manner as to comprise the switching element Q3 that short-circuits the current converting unit 5*a*. This enables the LED light source 4 with the plurality of functions to be lit by an external operation such as extinguishing the running lights while lighting the antidazzle lights of the headlights.

Embodiment 4

Figure 7:
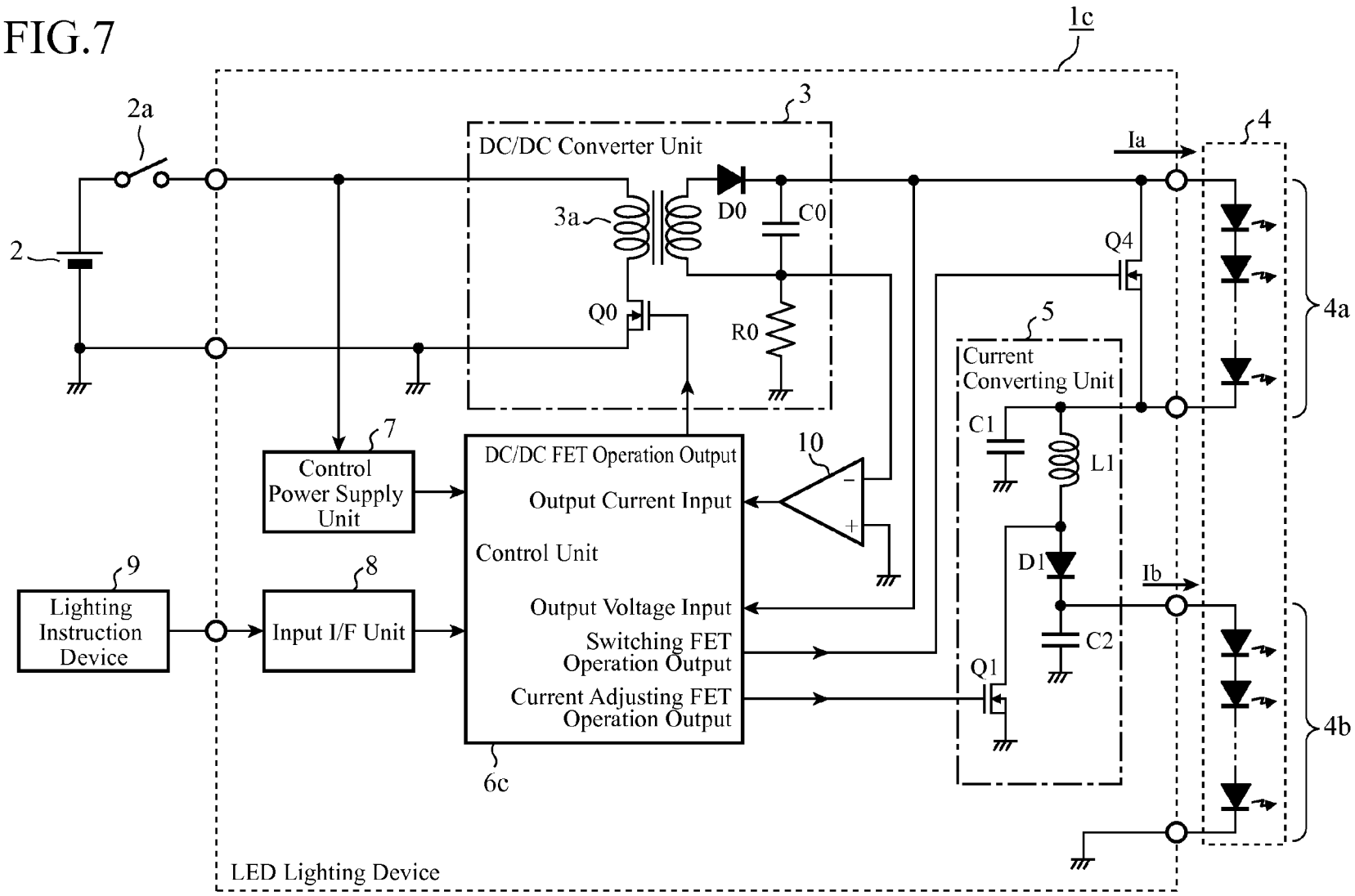
FIG. 7 is a circuit diagram showing a configuration of an LED lighting device of an embodiment 4 in accordance with the present invention.

FIG. 7 is a circuit diagram showing a configuration of an LED lighting device 1*c* of an embodiment 4 in accordance with the present invention. Incidentally, in FIG. 7, the same or like components to those of FIG. 1 are designated by the same reference numerals and their description will be omitted. In the present embodiment 4, a switching element Q4 (third switching element) that short-circuits or opens between the terminals of the LED block 4*a* is added to the LED lighting device 1 of the embodiment 1 shown in FIG. 1.

The switching element Q4 has its drain terminal connected to the connection point of the DC/DC converter unit 3 to the LED block 4*a*, and its source terminal connected to the connection point of the LED block 4*a* to the current converting unit 5. In addition, the switching element Q4 has its gate terminal connected to the switching FET operation output terminal of the control unit 6*c* to be switched on and off in response to the switching FET operation output signal.

The control unit 6*c* receives the control signal instructing the on/off operation of the switching element Q4 from the external lighting instruction device 9 via the input I/F unit 8, and turns the switching element Q4 on and off by outputting the switching FET operation output signal. When the switching element Q4 is off, the same lighting operation as that of the foregoing embodiment 1 is carried out. On the other hand, when the switching element Q4 is on, the LED block 4*a* has its two terminals short-circuited, and is extinguished.

For example, when applying the LED light source 4 to onboard rear combination lamps, the LED block 4*a* used for the taillight is extinguished during the daytime, and the LED block 4*b* used for the sidelights can be used as the directional indicator by the on/off operation of the switching element Q1.

As described above, according to the embodiment 4, the LED lighting device 1*c* is configured in such a manner as to comprise the switching element Q4 that short-circuits the two terminals of the LED block 4*a*. This enables lighting the LED light source 4 corresponding to a plurality of operations by an external operation such as extinguishing the taillight of the rear combination lamp.

Embodiment 5

Figure 8:
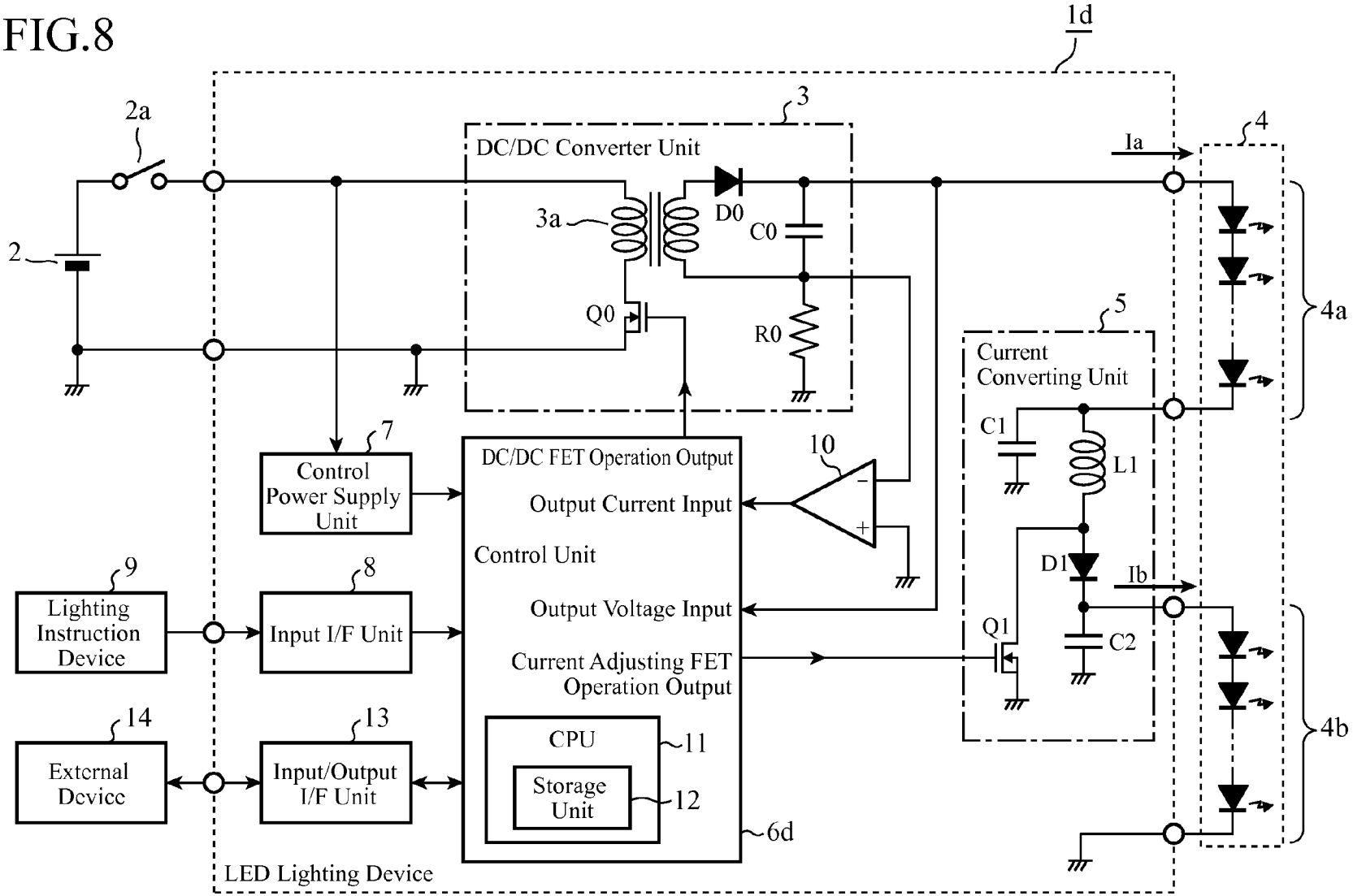
FIG. 8 is a circuit diagram showing a configuration of an LED lighting device of an embodiment 5 in accordance with the present invention.

FIG. 8 is a circuit diagram showing a configuration of an LED lighting device 1*d* of an embodiment 5 in accordance with the present invention. Incidentally, in FIG. 8, the same or like components to those of FIG. 1 are designated by the same reference numerals and their description will be omitted. The present embodiment 5 is configured in such a manner that a control unit 6*d* comprising a CPU 11 executes the control of the DC/DC converter unit 3 and the control of the current converting unit 5.

To output the current Ia and current Ib simultaneously by using the CPU 11 for the control as shown in FIG. 8, it is difficult for a single small-scale CPU to execute simultaneous processing of two DC/DC converters with feedback processing that requires complicated high-speed algorithm. In contrast with this, it is possible to employ a single DC/DC converter with feedback processing (DC/DC converter unit 3), and to add the processing of outputting a rectangular wave for current conversion with a fixed period and duty cycle. In other words, the control unit 6*d* can be constructed easily by using an inexpensive general-purpose CPU 11. Incidentally, to generate the rectangular wave with the fixed period and duty cycle, the timer embedded in the CPU 11 can be used.

Thus, the inexpensive general-purpose CPU 11 can be employed. The CPU 11 executes on the one hand the feedback processing using a complicated high-speed algorithm to output the DC/DC FET operation output signal (PWM signal) for driving the switching element Q0, thereby causing the DC/DC converter unit 3 to operate to output the current Ia. On the other hand, the CPU 11 outputs the current adjusting FET operation output signal with the fixed period and duty cycle to drive the switching element Q1, thereby converting the current Ia to the current Ib by the current converting unit 5 without executing the feedback processing (that is, by the open loop control).

A storage unit 12 comprises a nonvolatile memory element such as an EEPROM (Electrically Erasable Programmable Read-Only Memory) and flash memory, and stores setting information such as a target value of the current Ia to be subjected to the feedback control, and a target value of the current Ib to be subjected to the open loop control (or the period and duty cycle of the current adjusting FET operation output signal).

Furthermore, in the present embodiment 5, the control unit 6*d* can be connected to the external device 14 via the input/output I/F unit 13, which enables setting or altering the target values of the currents Ia and Ib to be stored in the storage unit 12. This enables the LED lighting device 1*d* with the same configuration to be adjusted to the characteristics of the LED light sources 4 with a plurality of characteristics. In addition, the setting can be changed after completing the product.

Incidentally, as for the LED lighting devices 1*a*-1*c* of the foregoing embodiments 2-4 in addition to the LED lighting device 1 of the foregoing embodiment 1, the control units 6, 6*b* and 6*c* can also be constructed using the CPU 11.

As described above, according to the embodiment 5, the LED lighting device 1*d* is configured in such a manner that the control unit 6*d* comprises the CPU 11, and that the CPU 11 executes on the one hand the feedback control of the DC/DC converter unit 3 by acquiring the output current to the LED light source 4, and carries out on the other hand the open loop control of the current converting unit 5. Accordingly, it can realize the LED lighting device 1*d* capable of outputting the currents Ia and Ib simultaneously using the inexpensive general-purpose CPU 11.

In addition, according to the embodiment 5, the LED lighting device 1*d* is configured in such a manner that it comprises the input/output I/F unit 13 that transfers between the control unit 6*d* and external device 14 the setting information used for controlling the DC/DC converter unit 3 and control unit 6*d*, and the CPU 11 including the storage unit 12 that stores the setting information input from the external device 14 via the input/output. I/F unit 13, and that the control unit 6*d* adjusts the output of the DC/DC converter unit 3 to the current Ia and the output of the current converting unit 5 to the current Ib in accordance with the setting information stored in the storage unit 12. Accordingly, it can cope with various LED light sources 4 with a plurality of characteristics by altering the setting information of the storage unit 12 by utilizing the LED lighting device 1*d* with the same configuration. Accordingly, the LED lighting devices 1*d* with the same configuration can be mass-produced, thereby being able to improve the productivity.

Incidentally, although the foregoing embodiments 1-5 are described by way of example that applies the LED lighting devices 1-1*d* to onboard illuminators such as the rear combination lamps and headlights, they are also applicable to various uses other than the onboard illuminators such as those described in the Patent Document 2 mentioned before, for example.

Incidentally, it is to be understood that a free combination of the individual embodiments such as a configuration that converts the output current Ia of the DC/DC converter unit 3 to both the smaller current Ib and to the greater current Ic, or variations of any components of the individual embodiments or removal of any components of the individual embodiments are possible within the scope of the present invention.

INDUSTRIAL APPLICABILITY

As described above, an LED lighting device in accordance with the present invention is configured in such a manner as to comprise the current converting unit connected in series with a plurality of LEDs, and to convert the current flowing through a part of the LEDs to the current different from the output current of the DC/DC converter. Accordingly, it is suitable for applications such as an LED lighting device that lights an onboard illuminator with a plurality of LEDs corresponding to a plurality of functions.

DESCRIPTION OF REFERENCE SYMBOLS

1, 1*a*-1*d* LED lighting device; 2 DC power supply; 2*a* power switch; 3 DC/DC converter unit; 3*a* transformer; 4 LED light source; 4*a*, 4*b* LED block; 5, 5*a* current converting unit; 6, 6*b*-6*d* control unit; 7 control power supply unit; 8 input I/F unit; 9 lighting instruction device; 10 inverting amplifier; 11 CPU; 12 storage unit; 13 input/output I/F unit; 14 external device.

What is claimed is:

1. An LED lighting device that supplies a first LED and a second LED connected in series prescribed currents generated from a power supply to light them, the LED lighting device comprising:

a DC/DC converter unit that generates a first current for lighting at least the first LED from the power supply;

a current converting unit that converts the first current to a second current for lighting the second LED; and a control unit that controls the DC/DC converter unit and the current converting unit, wherein the current converting unit is connected in series between the first LED and the second LED.

2. The LED lighting device according to claim 1, wherein the current converting unit comprises a coil, a first switching element and a diode; and the first switching element turns on and off a current flowing through the coil and the first switching element by an on/off operation in a prescribed duty cycle the control unit outputs.

3. The LED lighting device according to claim 1, wherein the second current the current converting unit generates is smaller than the first current the DC/DC converter unit generates.

4. The LED lighting device according to claim 1, wherein the second current the current converting unit generates is greater than the first current the DC/DC converter unit generates.

5. The LED lighting device according to claim 1, further comprising:

an input unit that supplies the control unit with a signal input from an external lighting instruction device, wherein the control unit switches between enabled and disabled states of the current converting unit in response to the signal from the lighting instruction device.

6. The LED lighting device according to claim 1, further comprising:

a second switching element that short-circuits the current converting unit.

7. The LED lighting device according to claim 1, further comprising:

a third switching element that short-circuits between terminals to which the first LED is connected.

8. The LED lighting device according to claim 1, wherein the control unit comprises a CPU; and the CPU carries out feedback control of the DC/DC converter unit, and carries out open loop control of the current converting unit.

9. The LED lighting device according to claim 8, further comprising:

an input/output unit that transfers, between the control unit and an external device, setting information used for controlling the DC/DC converter unit and the current converting unit; and a storage unit that stores the setting information input from the external device via the input/output unit, wherein the control unit adjusts output of the DC/DC converter unit to the first current and adjusts output of the current converting unit to the second current in accordance with the setting information stored in the storage unit.

10. The LED lighting device according to claim 1, wherein the LED lighting device lights LEDs operating as a light source of an onboard illuminator.

* * * * *